US010479042B2

(12) United States Patent
Patel et al.

(10) Patent No.: US 10,479,042 B2
(45) Date of Patent: Nov. 19, 2019

(54) MACHINE AND METHOD FOR MANUFACTURING PLASTIC POUCHES

(71) Applicant: Mamata Machinery Pvt. Ltd., Ahmedabad (IN)

(72) Inventors: Jayeshkumar Dahyabhai Patel, Ahmedabad (IN); Snehal Kanaiyalal Patel, Ahmedabad (IN); Kokeshkumar Kirtikumar Patel, Ahmedabad (IN)

(73) Assignee: Mamata Machinery Pvt. Ltd., Gujarat (IN)

( * ) Notice: Subject to any disclaimer, the term of this patent is extended or adjusted under 35 U.S.C. 154(b) by 569 days.

(21) Appl. No.: 15/022,198

(22) PCT Filed: Jul. 4, 2014

(86) PCT No.: PCT/IN2014/000449

§ 371 (c)(1),
(2) Date: Mar. 15, 2016

(87) PCT Pub. No.: WO2015/040631

PCT Pub. Date: Mar. 26, 2015

(65) Prior Publication Data

US 2016/0229146 A1 Aug. 11, 2016

(30) Foreign Application Priority Data

Sep. 18, 2013 (IN) ..... 3018/MUM/2013

(51) Int. Cl.
*B31B 37/00* (2006.01)
*B31B 70/18* (2017.01)
(Continued)

(52) U.S. Cl.
CPC ..... *B31B 70/18* (2017.08); *B31B 70/262* (2017.08); *B31B 70/266* (2017.08);
(Continued)

(58) Field of Classification Search
CPC ..... B31B 37/00; B31B 70/00; B31B 2155/00; B31B 2155/002; B31B 2160/20; B31B 70/148; B31B 2155/0014; B31B 2160/10
(Continued)

(56) References Cited

U.S. PATENT DOCUMENTS 1,949,879 A * 3/1934 Potdevin ..... B31B 70/00 493/235
2,387,274 A * 10/1945 Lee ..... B31B 70/00 493/213

(Continued)

*Primary Examiner* — Nathaniel C Chukwurah
*Assistant Examiner* — Lucas E. A. Palmer
(74) *Attorney, Agent, or Firm* — Grable Martin Fulton PLLC; Spencer C. Patterson

(57) ABSTRACT

The machine and the method disclosed use a panel plastic film that is longitudinally folded into top and bottom halves before slitting along the fold. The halves are simultaneously transported ensuring print registration and requiring a single accumulator in the longitudinal direction. Side gusset pieces are inserted between the top and bottom halves through an initial gap enlarged by a pair of timing belts. The top and bottom halves partly sealed with the side gusset pieces are pulled away from each other and a means gives the ends of the side gusset pieces the shape of a rhomboid. Bottom gusset film is vertically sealed along the vertical axis of the rhomboid shaped ends of the side gusset pieces with the seal extending to the folded portions of the top and bottom halves. Longitudinal sealing and transverse sealing before cutting ensure sealing of the bottom gusset and side gussets.

14 Claims, 16 Drawing Sheets

(51) Int. Cl.
*B31B 70/26* (2017.01)
*B31B 155/00* (2017.01)
*B31B 160/20* (2017.01)

(52) U.S. Cl.
CPC ..... *B31B 2155/00* (2017.08); *B31B 2155/001* (2017.08); *B31B 2155/002* (2017.08); *B31B 2155/0014* (2017.08); *B31B 2160/20* (2017.08)

(58) Field of Classification Search
USPC ..... 493/197
See application file for complete search history.

(56) References Cited

U.S. PATENT DOCUMENTS

RE23,486 E * 4/1952 Lee ..... B31B 70/00 493/213
2,643,588 A * 6/1953 Burroughs ..... B31B 70/00 493/213
3,534,666 A * 10/1970 Maccherone ..... B31B 70/00 156/717
4,016,808 A * 4/1977 Young ..... B31B 70/00 493/254
4,174,804 A * 11/1979 Bosse ..... B65D 31/02 383/109
4,273,549 A * 6/1981 Pezzana ..... B25H 3/04 493/196
4,610,651 A * 9/1986 Jacobson ..... B65D 75/68 493/212
4,680,024 A * 7/1987 Focke ..... B29C 65/18 493/197
4,832,677 A * 5/1989 Hudgens ..... B26D 3/14 493/196
4,837,849 A * 6/1989 Erickson ..... B29C 65/7437 383/104
4,913,693 A * 4/1990 Ball ..... B65D 33/065 493/194
4,954,124 A * 9/1990 Erickson ..... B29C 65/7437 156/308.4
5,080,643 A * 1/1992 Mitchell ..... B29C 65/7437 156/308.4
5,102,384 A * 4/1992 Ross ..... B31B 70/00 493/243
5,743,070 A * 4/1998 Lerner ..... B65B 43/123 198/819
6,425,847 B1 * 7/2002 Broenstrup ..... B31B 70/00 493/186
6,561,963 B2 * 5/2003 Totani ..... B65D 31/10 493/189
7,331,917 B2 2/2008 Totani
8,568,283 B2 * 10/2013 Broering ..... B31B 50/00 493/220
9,050,770 B1 * 6/2015 Russell ..... B31B 29/60
9,434,492 B1 * 9/2016 Russell ..... B65B 43/123
9,475,248 B1 * 10/2016 Russell ..... B31B 1/88
9,662,852 B2 * 5/2017 Nagata ..... B31B 19/14
9,962,898 B1 * 5/2018 Russell ..... B31B 37/00
2002/0147090 A1 * 10/2002 Kuge ..... B65D 31/10 493/162
2004/0109617 A1 * 6/2004 Winiecki ..... B65D 31/08 383/64
2005/0272583 A1 * 12/2005 Totani ..... B31B 70/00 493/162
2007/0274612 A1 * 11/2007 Chaturvedi ..... B65D 31/10 383/10
2010/0069212 A1 * 3/2010 Chaturvedi ..... B31B 70/00 493/214
2010/0162665 A1 * 7/2010 Tan ..... B26F 1/384 53/459
2010/0240512 A1 * 9/2010 Moulin ..... B65B 43/123 493/267
2011/0015052 A1 * 1/2011 Totani ..... B65D 31/08 493/189
2011/0039676 A1 * 2/2011 Totani ..... B31B 19/00 493/227
2012/0035035 A1 * 2/2012 Totani ..... B31B 37/00 493/193
2012/0214658 A1 * 8/2012 Chuba ..... B65H 20/06 493/405
2012/0231941 A1 * 9/2012 Senbo ..... B31B 50/00 493/189
2017/0203532 A1 * 7/2017 Totani ..... B31B 37/00

* cited by examiner

MACHINE AND METHOD FOR MANUFACTURING PLASTIC POUCHES

FIELD OF THE INVENTION

The present invention relates to a machine and a method for manufacturing plastic bags or pouches with three gussets.

BACKGROUND OF THE INVENTION

High speed machines and methods for manufacturing plastic bags or pouches in large quantities, are known. Also known are high speed machines and methods for manufacturing pouches with side gussets and bottom gusset. Manufacturing methods and machines are also known and available for producing standing plastic pouches. Plastic pouches with or without gussets can be produced having a top that can be closed and opened.

Machines for producing plastic pouches having gussets and methods for producing the same have been patented.

U.S. Pat. No. 7,331,917 discloses a Bag Making Machine which uses separate sources for the top and bottom or front and back plastic web panels requiring multiple accumulators. The separate feeding of the web panel films causes mismatch of designs necessitating a re-unification assembly to address the design matching problem. Apart from this, the machine according to this invention provides little flexibility in terms of the width of the plastic film that the machine can use.

US Patent application no. 2012/0231941 discloses a Plastic bag making apparatus wherein the gusset portions have been separately attached and temporarily fixed to the main two films. The gusset portions need to be separately attached because of which the process is long and to match the registration or print of the plastic bags becomes difficult. Such process has a need for re-unification assembly so as to overcome the barrier of mechanical distance and hence, the machine and method makes it difficult to manufacture gusseted plastic bags compromising production efficiency.

U.S. Pat. No. 6,796,932 discloses a manufacturing method and apparatus for manufacturing gusseted bag using two separate films and a bottom gusset. However, the bottom gusset structure is separately placed between the two layers of the main film and then heat-sealed to form the bottom gusset. In this invention two main plastic films and one bottom gusset plastic film have been used requiring multiple accumulators. The machine does enhance production efficiency, but it increases the cost of manufacturing the plastic bags with gussets as three separate plastic films have been used. The machine also requires large floor space for installation and operation.

The present invention alleviates the abovementioned disadvantages and shortcomings of the machines and processes for manufacturing plastic pouches with three gussets.

SUMMARY OF THE INVENTION

The principal object of the machine and method in accordance with the present invention is to provide a simplified machine for manufacturing plastic pouches or bags having two side gussets and one bottom gusset. Since the source of the panel plastic film unlike in the prior art is common the problem of mismatch in design registration is efficiently solved. This also eliminates the need for having more than one accumulator in longitudinal direction. Also, the need for having a means and a method to unite at some point the differently fed top and bottom halves of the plastic film is eliminated.

Additionally, the method of transforming the ends of the side gusset pieces into rhomboid shaped ends as disclosed in the present invention eliminates the need of complicated machinery and thereby provides an efficient, accurate and simplified method for producing the said rhomboid shaped ends. This also eliminates complicated machinery found in the prior art.

Having fewer components reduces not only the cost of the machine, but also reduces the floor space occupied by the machine. This is another object of the present invention.

The present invention is flexible to make plastic pouches that are tall and wide. The prior art machines cannot handle tall plastic bags clue to inflexibility of the machine to handle wide panel plastic film.

As aforementioned, the machine and the method in accordance with the present invention use a panel plastic film from a single unwinding reel as opposed to the different sources for providing top and bottom panel films as in the prior art.

The panel plastic film is longitudinally folded into top and bottom halves and is transported in longitudinal or machine direction. A slitter slits the panel plastic film along the longitudinal fold to cut the film into to and bottom halves. The top and bottom halves simultaneously get transported ensuring that any design common to the top and bottom halves will always accurately match unlike the prior art machines where the top and bottom halves originate from separate sources and at some stage, using complicated machinery, are united. The machine in accordance with the present invention, because of this unique feature of providing the top and bottom halves from folding the panel plastic film unwound from a single unwinding reel, requires only a single accumulator. This significantly reduces the complexity of the machine and requires fewer parts than the machines disclosed in the prior art.

The slitting of the top and bottom halves by the slitter creates an initial gap between the top and bottom halves of the panel plastic film. The said gap is enlarged by a pair of timing belts positioned transversely such that the bottom portion of the top timing belt is substantially in contact with the top portion of the bottom timing belt. The said timing belts have teeth on the inside. The teeth of the timing belts mesh with the teeth on the sprockets on either side. The top half of the panel plastic film passes through the first timing belt such that the bottom surface of the top half of the panel plastic film is in contact with the top of the teeth on the lower portion of the top timing belt. Similarly, the bottom half of the panel plastic film passes through the bottom timing belt such that the top surface of the bottom half of the panel plastic film is in contact with the top of the teeth on the top portion of the bottom timing belt. Thus, the gap between the top and bottom halves of the panel plastic film will be substantially equal to the total of thicknesses of the top and bottom timing belts including the heights of the teeth on both the timing belts. The enlargement of the gap at this stage is required to allow insertion of the side gusset pieces between the top and bottom halves of the panel plastic film.

The machine in accordance with the present invention can have the feeding line for side gusset pieces that can be transversely positioned on either side of the machine depending on the requirements of the customer and space constraints. Side gusset film is unwound from an unwinding reel and is guided by a guide roller to be directed to an accumulator roller. The side gusset film exits a nip and gets folded by a folding device such that the folded portions are on the top and the total width of the top folded portions is substantially same as the width of the bottom portion of the side gusset film. A creasing device ensures that the front and rear folded edges maintain their crease. The side gusset film gets further transported in the transverse direction through an index nip and gets cut into side gusset pieces by a cutter. The rate of indexing depends on the positioning of the side gusset pieces between the top and bottom halves of the panel plastic film. In other words, the width of the plastic pouch will determine how far apart the side gusset pieces are positioned between the top and bottom halves of the panel plastic film which in turn determines the rate of indexation. Therefore, the wider the plastic pouch, the slower will be the rate of indexation and vice versa. The side gusset pieces get inserted between the top and bottom halves of the panel plastic film through the said enlarged gap.

A transverse heat sealer seals the side gusset pieces with the top and bottom halves of the panel plastic film. The seal is along the length of the side gusset pieces sealing the free edges of the top folded portions with the top half of the panel plastic film and the corresponding middle of the bottom portions of the side gusset piece with the bottom half of the panel plastic film.

The next stage is to give the ends of the side gusset pieces the shape of a rhomboid. The top half and the bottom half of the panel plastic film are pulled away from each other. This action opens the side gusset pieces in such a way that the cross-section of the space inside the side gusset pieces resembles a rhomboid like shape having a rounded corner on the front folded edge as well as on the rear folded edge of the side gusset piece ends. Using a roller, the said front rounded corner is pushed inwards near the vertical axis of the rhomboid shaped space and similarly, using another roller, the rounded rear corner is also pushed inwards to be near the said vertical axis. This action transforms the end of the side gusset pieces into rhomboid shaped ends that will now have a new front corner on the front folded edge and a new rear corner at the rear folded edge. Also, it will have a top corner at the seal and a bottom corner at the seal.

The pulling action of the top and bottom halves of the panel plastic film will result into a folded portion of the top half and similarly, a folded portion of the bottom half of the panel plastic film. The folded portions are relatively small in size compared to the remaining greater portions of the top and bottom halves and are generally perpendicular to the remaining greater portions of the top and bottom halves of the panel plastic film.

The edge of the folded portion of the top half will project beyond the top corner of the rhomboid shaped ends and likewise, the edge of the folded portion of the bottom half will project beyond the bottom corner of the rhomboid shaped ends. In other words, the combined height of the folded portions of the top half and the bottom half of the panel plastic film will be greater than the height of the rhomboid shaped ends.

Bottom gusset film unwinding from and unwinding reel is transported in transverse direction up to a point where a turn bar is provided which changes the direction as well as the orientation of the bottom gusset film which gets reoriented to be now transported in longitudinal direction such that the edges of the bottom gusset film remain horizontal, but in a plane perpendicular to the plane when it was being transported transversely. In this position, the bottom gusset film would be substantially parallel to the rhomboid shaped ends as well as the folded top and bottom portions of the panel plastic film. The bottom gusset film at this stage is substantially in contact with the full faces of the rhomboid shaped ends as also the folded top and bottom portions of the top and bottom halves of the panel plastic film.

The next stage is to vertically heat-seal the bottom gusset with the rhomboid shaped ends along the vertical axis of the rhomboid shaped ends of the side gusset pieces. The bottom gusset also gets sealed with the top and bottom folded portions of the top and bottom halves of the panel plastic film where the top and bottom folded portions respectively project above and below the top and bottom corners of the rhomboid shaped ends.

The top and bottom halves of panel plastic film together with side gusset pieces and the vertically sealed bottom gusset film with the rhomboid shaped ends as well as the folded portions of the top and bottom halves of panel plastic film get further transported in longitudinal direction. The bottom gusset film with the rhomboid shaped ends as well as the folded portions of the top and bottom halves of panel plastic film pass through an index nip.

The next step is to collapse the bottom gusset film with the rhomboid shaped ends as well as the folded portions of the top and bottom halves of panel plastic film such that the rhomboid shaped ends have the top corners substantially contacting the bottom corner resulting in a triangular top part and a triangular bottom part. At this stage, the top and bottom edges of the bottom gusset film also would be substantially in contact with each other as well as the edge of the top half and the edge of the bottom half also would be substantially in contact with each other. It can be seen that at this stage, the folded portions of the top and bottom halves of the panel plastic film get unfolded.

The so collapsed top and bottom halves of panel plastic film together with side gusset pieces and the bottom gusset film with the rhomboid shaped ends as well as the folded portions of the top and bottom halves of panel plastic film get further transported in longitudinal direction and are ready for final longitudinal and transverse sealing before getting cut into pouches.

A longitudinal heat sealer seals the top edge of the bottom gusset film with the edge of the top half of the panel plastic film and simultaneously, in a reciprocating action, the bottom edge of the bottom gusset film gets longitudinally sealed with the edge of the bottom half of the panel plastic film.

A transverse heat sealer seals the top edge of the side gusset pieces with the edge of the top half of the panel plastic film in a reciprocating action, the bottom edge of the side gusset pieces get sealed with the bottom half of panel plastic film.

The transverse sealing also seals the front collapsed edge of the bottom gusset film with the corresponding collapsed edge of the side gusset piece in the front. Similarly, the rear collapsed edge of the bottom gusset film gets sealed with the corresponding collapsed edge of the side gusset piece in the rear.

The next step is to cut along the transverse seal and more than one cut may be required to produce plastic pouches having two side gussets and one bottom gusset.

DETAILED DESCRIPTION OF THE DRAWINGS

The machine in accordance with the present invention is designed and arranged to efficiently make plastic bags or pouches, each of which includes two side gussets and a bottom gusset.

Plastic bags and pouches come in a wide variety. Most plastic bags will have something printed on them. The printing may include words or artwork. Many times, the artwork on the front and the back sides of the plastic bags or pouches will be identical and symmetrical. Such plastic bags or pouches may be transparent, translucent, or opaque. In any case, whether the plastic bags or pouches are transparent, translucent, or opaque, the artwork on both the sides must match. This poses a technical problem which most manufacturers struggle to solve. Complicated and expensive machineries have been invented and developed. Some have even been patented as described hereinabove. Such matching of the artwork or design or print registration in the machine in accordance with the present invention is achieved accurately and in a simplified manner. Also, the insertion and placement of the side gussets between the top and bottom panel plastic films or front and back as the case may be, is achieved in a simplified manner utilizing fewer machine components.

The principles of operation of the machine in accordance with the present invention and the method of using the machine to produce plastic pouches with two side gussets and a bottom gusset will be described hereinbelow with reference to the accompanying drawings.

The machine in accordance with the present invention includes several parts. In the description of the machine in accordance with the present invention, the machine direction is referred to as the longitudinal direction as the transformation of the panel plastic film or the mother film into final products such as plastic bags or pouches occurs in this direction. The panel plastic film or mother film will have to be fed into the machine. In the machine in accordance with the present invention, this is done using an unwinding means and a folding means positioned such that the feeding of the panel plastic film or mother film occurs in a direction transverse to the longitudinal or machine direction. This feeding line is positioned to be on a side that is opposite to the side where such feeding lines for side gussets and bottom gusset film are located in the machine in accordance with the present invention. Location of such feeding lines could be altered to suit the floor space available and according to the choice of the plastic bag or pouch manufacturer.

Figure 1:
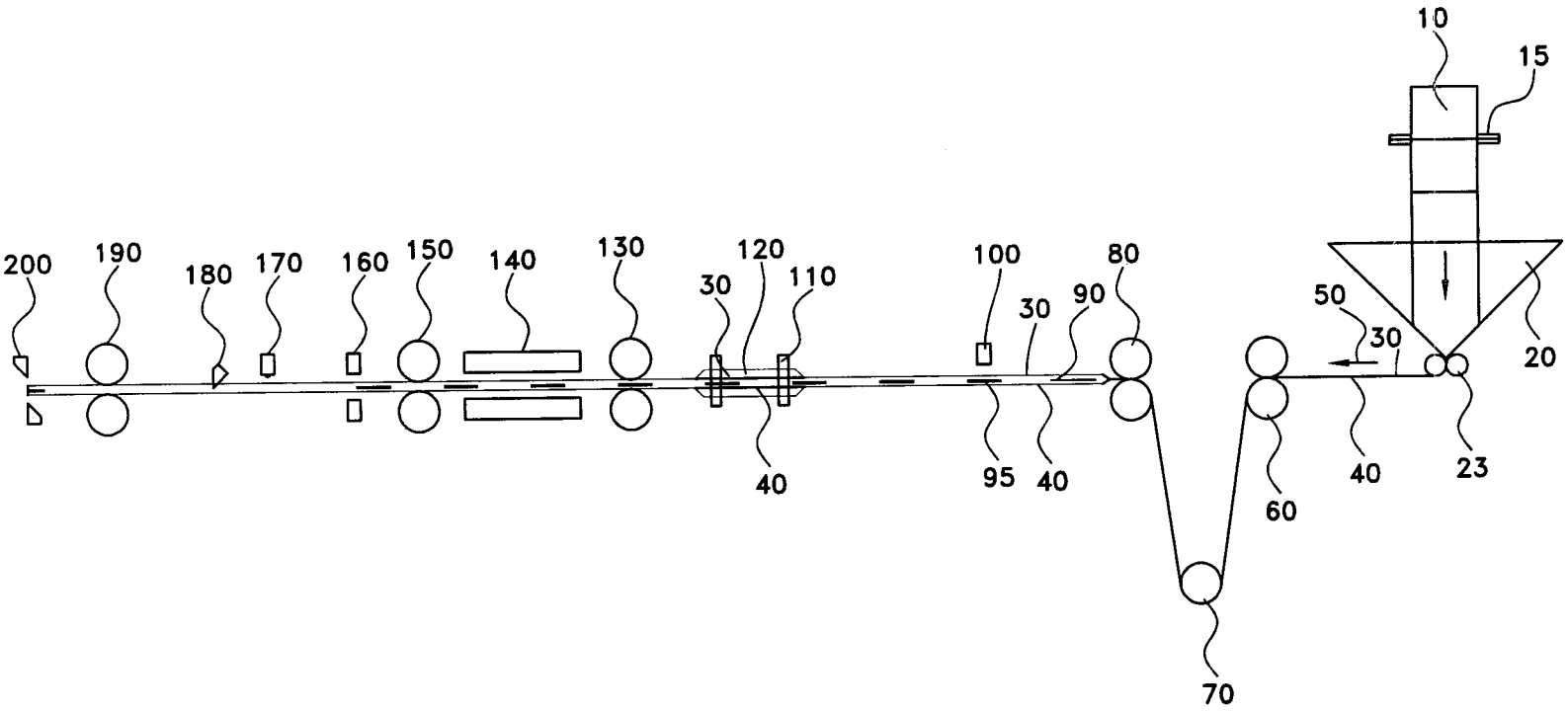
FIG. 1 shows substantially a side view of the major components in the longitudinal direction of the machine in accordance with the present invention.

Thus, FIG. 1 shows a side view of the major components in the longitudinal direction 50 of the machine in accordance with the present invention. Panel plastic film 10 is shown to be unwinding from the unwinding reel 15. A folding device 20 folds into two equal halves—top and bottom—the panel plastic film 10. This is shown to happen in a direction transverse to the machine or the longitudinal direction 50; however, this could be done in other manner as a person skilled in the art would readily understand.

The panel plastic film 10, if it is having identical or symmetric design or artwork on the top and bottom halves or the front and back sides, the design or artwork will be accurately matched or registered here itself with the folding into two equal halves.

The folded panel plastic film 10, now having the top half 30 and bottom half 40, is transported using guide rollers 23 in longitudinal direction 50 to a single accumulator 70 through a capstan nip 60. Since the machine in accordance with the present invention uses a single source for the top and bottom halves 30 and 40 respectively of the panel plastic film 10, it uses only a single accumulator 70 in the longitudinal direction 50. Thus, the machine in accordance with the present invention provides for accurate design registration using fewer components and a simplified method as will be explained hereinbelow.

The folded panel plastic film 10 into top and bottom halves 30 and 40 respectively is further transported in longitudinal direction 50 through an index nip 80. Film slitter 90 slits along the fold the folded panel plastic film 10 into top and bottom halves 30 and 40 respectively. The slitter also creates an initial gap between the top half 30 and bottom half 40.

Figure 2:
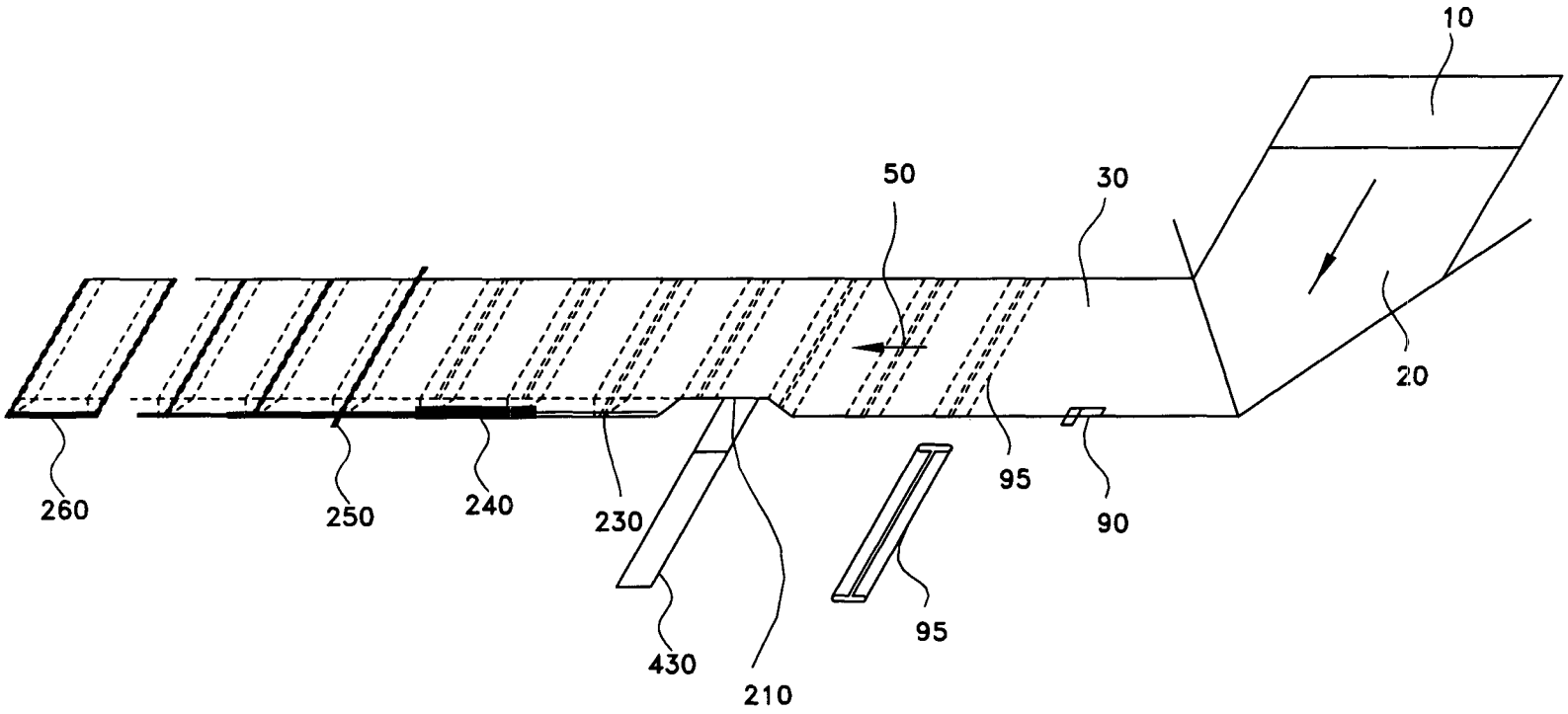
FIG. 2 shows a diagrammatic perspective representation of the transformation of the panel plastic film into plastic pouch with placement of side gussets at intervals and bottom gusset attachment at stages in accordance with the present invention.

FIG. 2 shows a diagrammatic perspective representation of the transformation of the panel plastic film 10 into plastic pouch 260 with placement of side gussets 95 at fixed intervals and bottom gusset film 430 attachment at different stages in accordance with the present invention. Also, shown is the longitudinal seal 240 sealing the bottom gusset 430 with the side gussets 95 and the top and bottom halves of the panel plastic film 30 and 40 respectively. Transverse seal 250 seals side gussets 95 with the bottom gusset film 430 and the top half 30 and bottom half 40 of the panel plastic film 10.

FIGS. 1 and 2 show the overall progression of the transformation of the panel plastic film 10 into plastic pouch 260. Detailed operation of the feeding lines for the side gussets 95 and bottom gusset film 430 will be explained with reference to other drawings.

Figure 3:
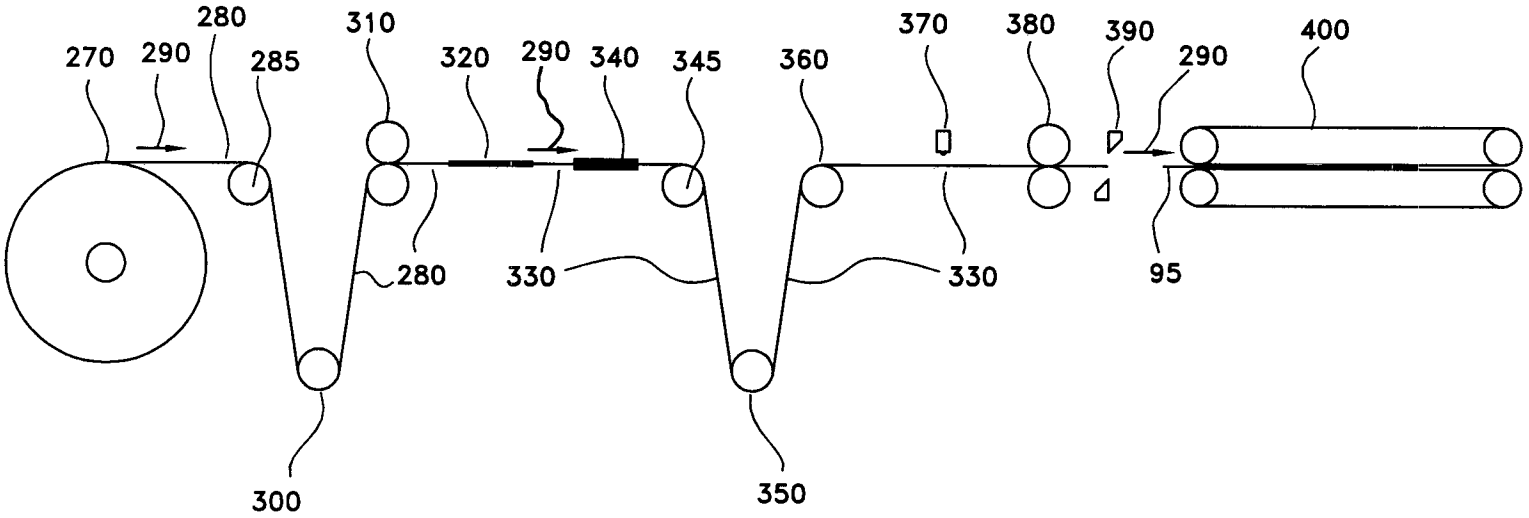
FIG. 3 shows the side view of the major components of the machine in accordance with the present invention arranged in transverse direction for the purpose of providing side gusset pieces.
Figure 4:
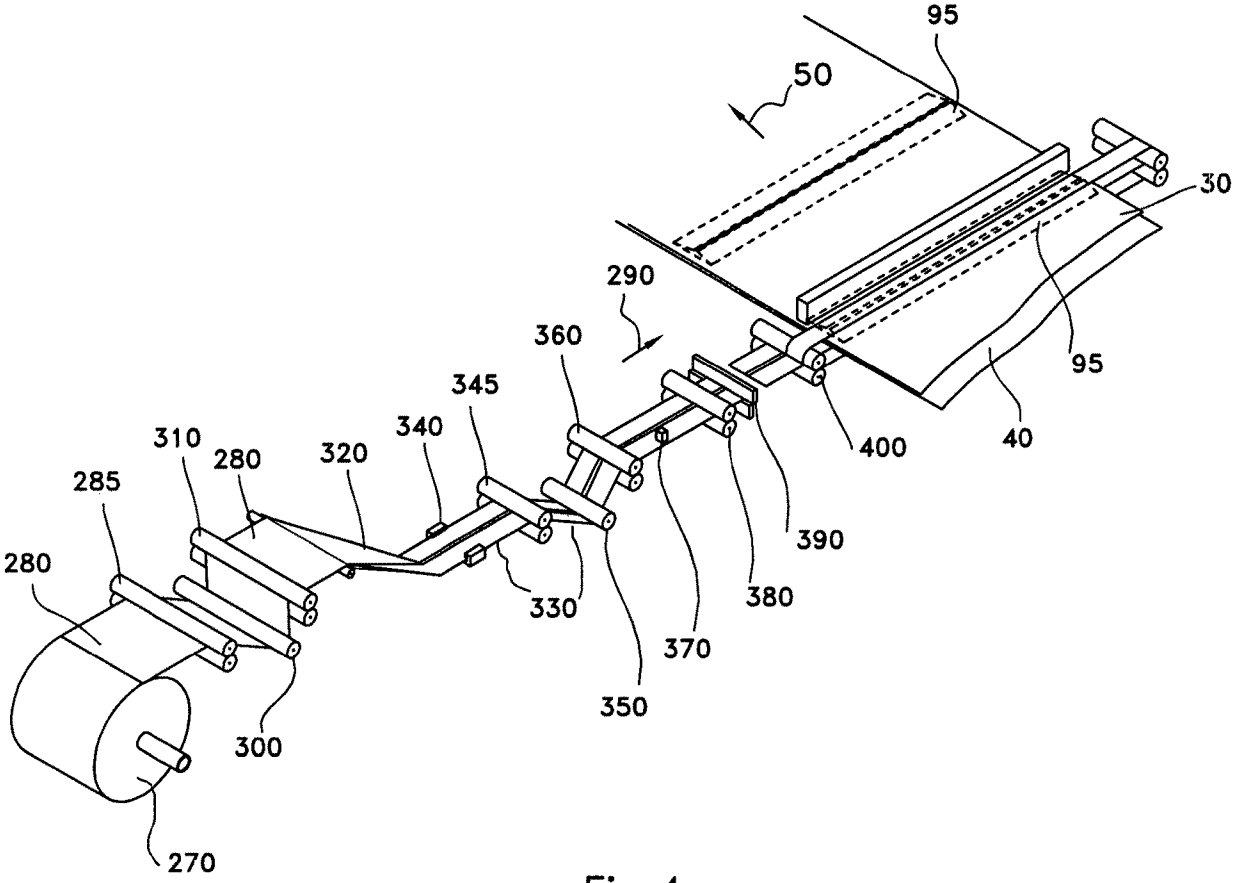
FIG. 4 shows a diagrammatic perspective representation of the transformation of the side gusset film into side gusset pieces in accordance with the present invention.

FIG. 3 shows the side view of the major components of the machine in accordance with the present invention arranged in transverse direction 290 for the purpose of providing side gusset pieces 95. Side gusset film 280 is unwound from the unwinding reel 270 in the transverse direction 290. Bending around capstan nip 285, the side gusset film 280 is transported around accumulator roller 300 and is further transported in transverse direction 290 through capstan nip 310. At this stage, the side gusset film 280 is longitudinally folded using folding means 320 and a creasing device 340 shown in FIG. 4 such that the front and rear folded portions 335 and 336 respectively are on the top and the combined width of the front and rear folded portions 335 and 336 respectively is substantially same as the width of the bottom portion. FIG. 4 shows a diagrammatic perspective representation of the transformation of the side gusset film 280 into side gusset pieces 95 in accordance with the present invention. As shown in FIG. 4, the folded side gusset film 330 is further transported through capstan nip 345 around accumulator roller 350 and through a tail feed 360. A print marker 370 at this stage can be used to mark the print. The folded side gusset film 280 is further transported in transverse direction 290 through an index nip 380 into cutter 390 where the folded side gusset film 280 is cut into side gusset pieces 95 such that the length of the side gusset pieces 95 is not more than the width of the top half 30 or bottom half 40 of the panel plastic film 10.

Figure 3A:
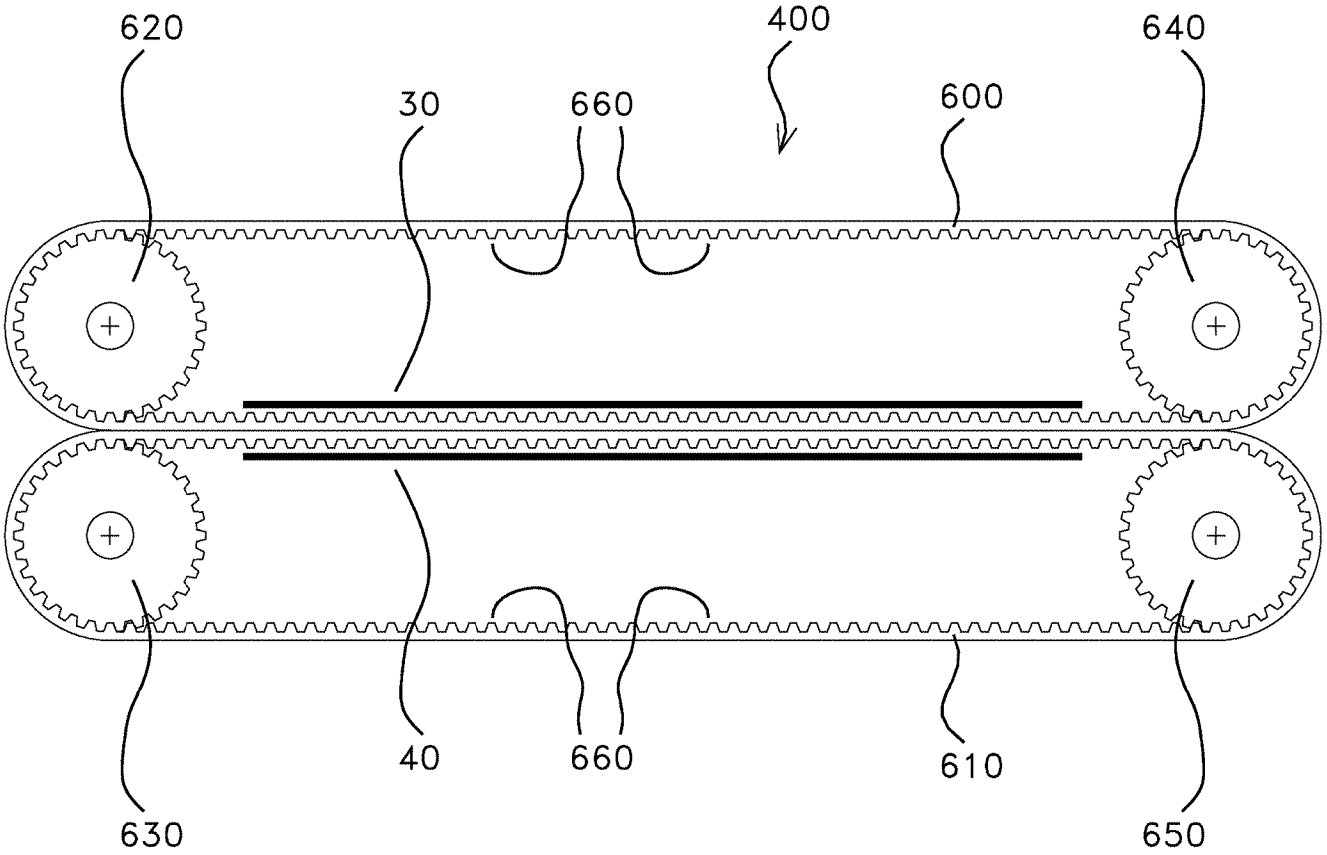
FIG. 3A shows cross-section of the top and bottom timing belts with their sprockets and the enlarged gap between the top and bottom halves of the panel plastic film.

In order to enlarge the initial gap created by the film slitter 90 between the top half 30 and bottom half 40 of the panel plastic film 10, as shown in FIG. 3A, top timing belt 600 and bottom timing belt 610 are used that are positioned transversely on the machine such that the top half 30 and bottom half 40 of the panel plastic film 10 contact the teeth 660 of the timing belts 600 and 610. The teeth 660 of the top timing belt 600 mesh with the teeth on the sprockets 620 and 640 on either ends. Similarly, the teeth 600 of the bottom timing belt 610 mesh with the teeth on the sprockets 630 and 650 on either ends. The relative positioning of the top timing belt 600 and bottom timing belt 610 is such that the outer toothless surfaces thereof are contacting each other substantially the entire length and width of the timing belts 600 and 610. In other words, the bottom part of the top timing belt 600 is substantially fully in contact with the top part of the bottom timing belt 610. The top half 30 of the panel plastic film 10 is in contact with the teeth 660 of the top timing belt 600 on the bottom part and the bottom half 40 of the panel plastic film 10 is in contact with the teeth 660 of the bottom timing belt 610 on the top part. Thus, the gap between the top half 30 and bottom half 40 of the panel plastic film 10 will be substantially same as the thicknesses of the bottom part of the top timing belt 600 and the top part of the bottom timing belt 610 including the heights of the teeth 660 thereon.

Now, the side gusset pieces 95 at the stage when the gap between the top half 30 and bottom half 40 is enlarged, is ready to be placed between the said top half 30 and bottom half 40 of the panel plastic film 10. Transfer assembly 400 further transports side gusset pieces 95 for placement of the side gusset pieces 95 between top half 30 and bottom half 40 of the panel plastic film 10. The length of the side gusset pieces 95 is generally less than the width of the top half 30 or bottom half 40. The length of the side gusset piece 95 is such that the leading end of the side gusset pieces reach the far edge of the top half 30 and bottom half 40; however, the trailing end remains inside the edge of the top half 30 and bottom half 40. The indexing of the side gusset pieces 95 is timed in accordance with the width of plastic pouch 260. For example, for a wider plastic pouch 260, the indexing of side gusset pieces 95 would be done at a slower rate so that the side gusset pieces 95 are placed between top half 30 and bottom half 40 further apart from each other. Similarly, for a narrower plastic pouch 260, the indexing of the side gusset pieces 95 will be done at a faster rate so that when the side gusset pieces 95 are placed between top half 30 and bottom half 40, the distance between them will be smaller.

As described hereinabove, the length of side gusset pieces 95 can be same as the width of top half 30 and bottom half 40; however, the length is so chosen that it is generally shorter than the width of top half 30 or bottom half 40 leaving a small portion of the top half 30 and bottom half 40 that will not be in contact with side gusset pieces 95. This small portion without such contact would be generally on the side where the side gusset pieces 95 are transversely transported from.

Figure 5A:
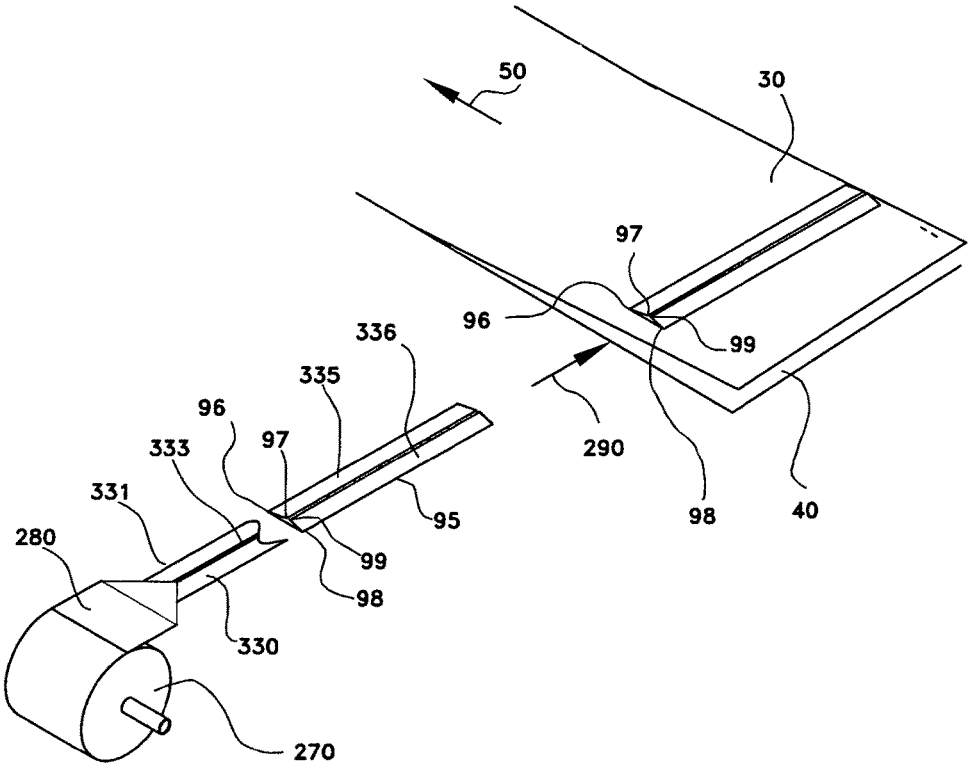
FIG. 5A shows a diagrammatic perspective representation of the insertion of the side gusset piece through the enlarged gap between the top and bottom halves of the panel plastic film in accordance with the present invention.
Figure 5B:
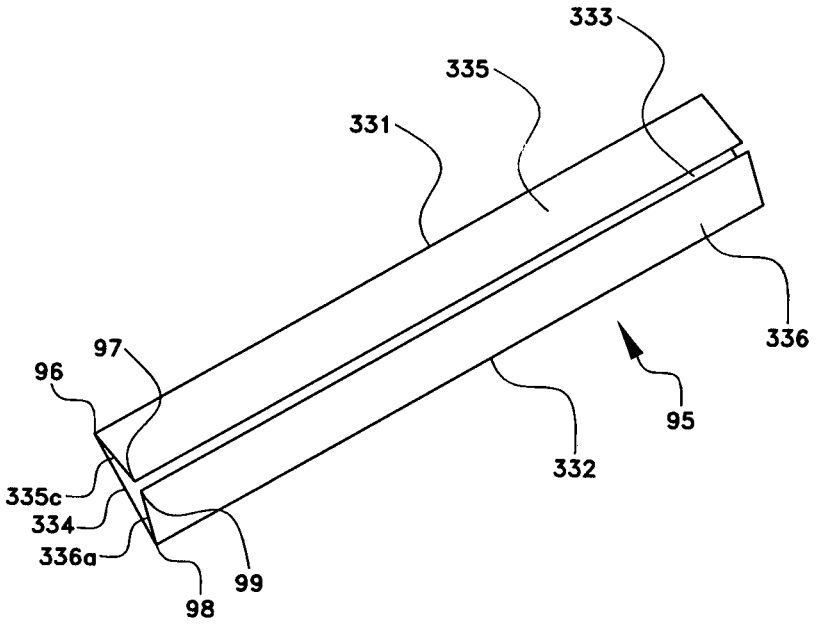
FIG. 5B shows in an enlarged view side gusset piece showing the longitudinal gap and various corners and edges.

FIG. 5 shows the transformation of side gusset film 280 into side gusset pieces 95 and placement of side gusset pieces 95 between top half 30 and bottom half 40 of the panel plastic film 10 without showing most of the components or parts of the machine. Thus, side gusset film 280 after getting unwound from unwinding reel 270 is folded into folded side gusset film 330 having the combined width of the top front folded portion 335 and top rear folded portion 336 substantially the same as that of the bottom portion of the folded side gusset film 330.

The folded side gusset film 330 gets cut into side gusset pieces 95. The free edges of the top folded portions 335 and 336 will not be in contact with each other and there will be a longitudinal gap 333 between the said edges. The side gusset pieces 95 will be transported in transverse direction 290 and later on will be transported in the longitudinal direction 50 together with the top and bottom halves 30 and 40 respectively. The thin and flat space at the end of the side gusset piece 95 defined by the bottom edge 334, the edge 335*a* of the top front folded portion 335, and the edge 336*a* of the top rear folded portion 336 subsequently takes the shape similar to a rhomboid in which the front corner 96 and rear corner 98 will become part of a somewhat generous radius as described hereinafter. The front fold 331 is formed between the top front folded portion 335 and the bottom portion of the side gusset piece 95. Similarly, the rear fold 332 is formed between the top rear folded portion 336 and the bottom portion of the side gusset piece 95.

Figure 6A:
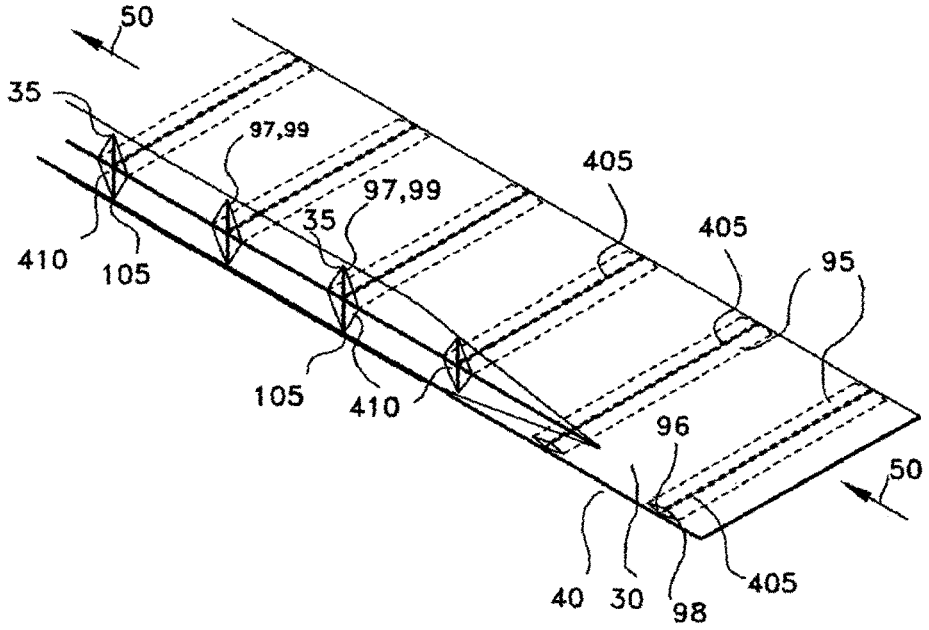
FIG. 6A shows the partial transverse sealing of the side gusset pieces with the panel plastic film and transformation of the ends of the side gusset pieces into rhomboid shape.
Figure 6B:
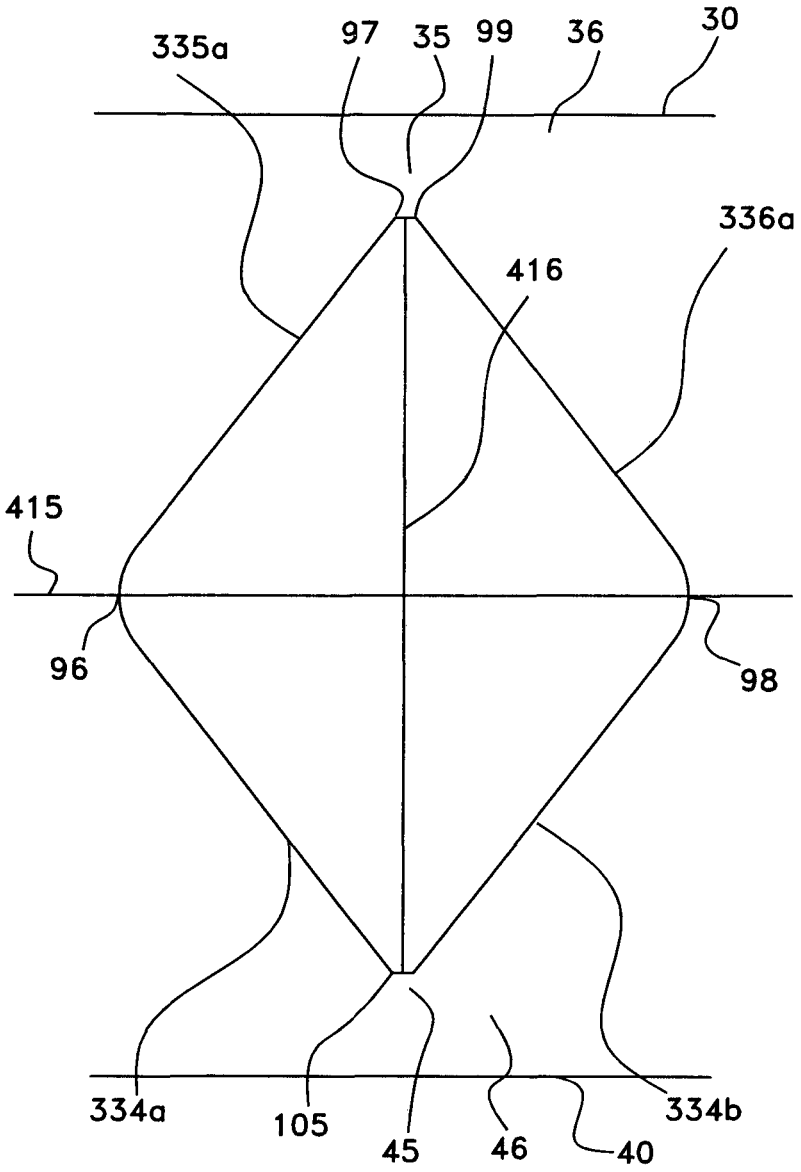
FIG. 6B shows the rhomboid-like and side gusset piece after the top half and the bottom half of the panel plastic film are pulled away from each other.

Now referring to FIG. 6A, the side gusset pieces 95 are transversely sealed using a heat sealer 100 such that at least the free edges of the front folded portion 335 and the rear folded portion 336 get sealed with the bottom surface of the top half 30 and the corresponding middle of the bottom portion gets sealed with the top surface of the bottom half 40. The seal 405 extends beyond the length of the side gusset pieces 95 as can be seen in the said figure so that when the top half 30 and bottom half 40 are pulled away from each other, the side gusset pieces 95 also get opened up transforming the otherwise thin and flat space at the end into a shape similar to a rhomboid having rounded corners at the front and rear. In other words, the free edges of the top front folded portion 335 and the top rear folded portion 336 that are sealed with the bottom surface of top half 30 will move with top half 30 and the corresponding middle of the bottom portion of the side gusset pieces 95 sealed with the top surface of the bottom half 40 will move with the bottom half 40. With such action of pulling away the top half 30 and the bottom half 40, the thin and flat space of the side gusset pieces 95 at the end will become substantially a rhomboid shape space with the corners 97 and 99 together forming the top corner of the rhomboid shape with the seal 405 and the corners 96 and 98 forming the front and rear rounded corners of the rhomboid shape. The bottom corner 105 would be formed at the location of the middle of the bottom portion of the side gusset piece 95 with the seal 405 (not shown) for the bottom portion. The top corners 97 and 99 of the rhomboid shape would be stuck with the top half 30 and the corresponding bottom corner 105 of the side gusset piece 95 of the rhomboid shape would be stuck with the bottom half 40. This is illustrated in greater detail in FIG. 6B that also shows dotted line 415 that divides in half the folded portion 36 of the top half 30 and folded portion 46 of the bottom half 40. As can be seen in the FIG. 6B, the bottom edge 334 now assumes a different shape from the flat shape it originally had. Now, the bottom edge 334 is transformed into edge 334*a* and 334*b* with the bottom corner 105 at the location where the seal 405 took place. The front fold 331 and rear fold 332 at this end of the side gusset pieces 95 turn into radius and as a result, the front and rear corners 96 and 98 respectively also become part of this generous radius. In other words, the opening resembles the shape of a rhomboid except for the two generous radii where the front and rear corners 96 and 98 are located. The free edges of the top front folded portion 335 and the top rear folded portion 336 are no longer free because of the seal 405 and therefore, the top corner 97 and 99 become together the top corner of the rhomboid-like shape. The rhomboid-like shape will have a vertical axis 416.

Figure 6C:
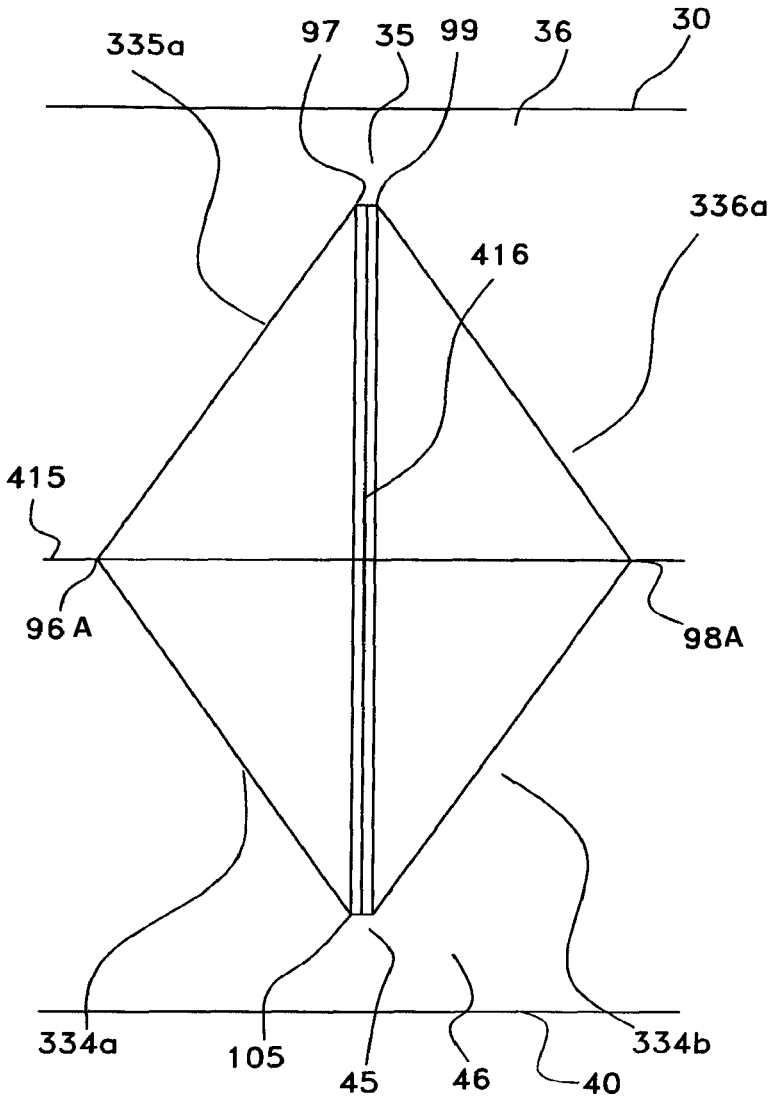
FIG. 6C shows rhomboid shaped end of the side gusset piece after the front and rear corners are pushed inwards forming vertical edges on either side of the vertical axis of the rhomboid.
Figure 6D:
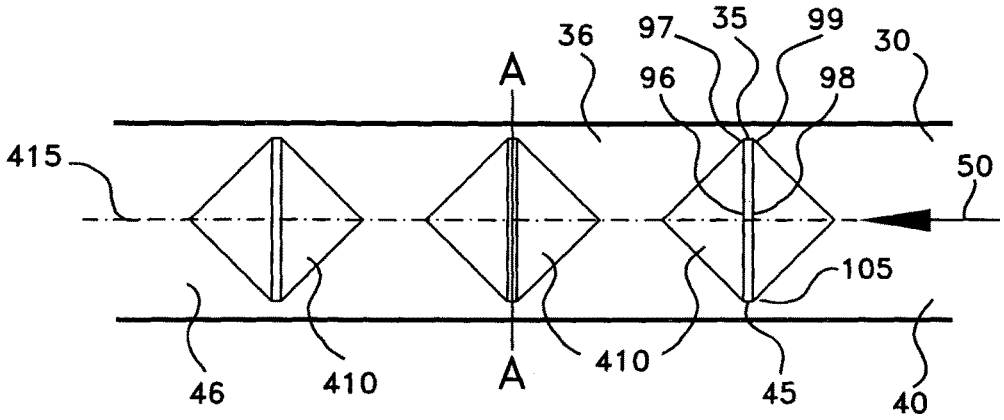
FIG. 6D shows rhomboid shaped ends of the side gusset pieces and the top and bottom folded portions of the top and bottom halves respectively.

At this stage, a pair of rollers (not shown) are brought in contact with the end of side gusset piece 95 such that contact of front corner 96 with the roller pushes the said front corner 96 rearwards and similarly, contact of rear corner 98 pushes the said rear corner 98 forward. Thus, the rollers push the said front corner 97 and rear corner 98 inwards into the rhomboid shaped cross sectional gap of the side gusset piece 95 so as to form another rhomboid shape of the end of the side gusset piece 95 with parts of the end of the side gusset piece 95 folded in the manner described. Now referring to FIG. 6C, the rhomboid shaped end 410 of the side gusset piece 95 shows the moved front corner 96 and rear corner 98 to be substantially along the vertical line 416. FIG. 6C also shows newly created front corner 96A along the front fold 331 and rear corner 98A along the rear fold 332. Thus, on either side of the vertical line 416, there will be parallel vertical edges, on the front of the vertical line 416 the vertical edge formed by edge 335*a* of the top front folded portion 335 and edge 334*a* which was part of the bottom edge 334. The moved front corner 96 lies exactly in the middle of this front vertical edge where the longitudinal dotted line 415 passes. Similarly, on the rear of the vertical line 416, there will be a vertical edge formed by edge 336*a* of the top rear folded portion 336 and edge 334*b* which was part of the bottom edge 334. The moved rear corner 98 lies exactly in the middle of the rear vertical edge where the longitudinal dotted line 415 passes. The slight distance on either side of the vertical axis 416 is the result of the thickness of the seal 405 on the top and bottom of the side gusset pieces 95.

Figure 6E:
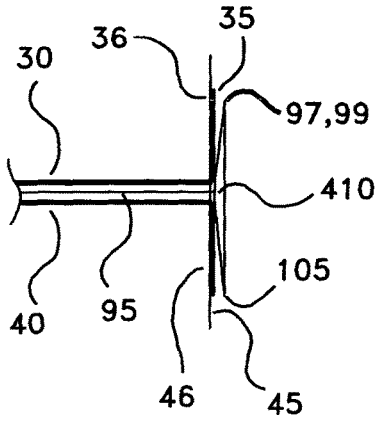
FIG. 6E is a transverse cross-section of the side gusset piece placed inside the top and bottom halves of the panel plastic film showing the folded portions of the top and bottom halves of the panel plastic film and the rhomboid shaped end of the side gusset piece.

As can be seen, longitudinal dotted line 415 divides into substantially equal top and bottom halves the rhomboid shaped end 410. Since the side gusset pieces 95 shown in the said figure are shorter in length than the width of top half 30 and bottom half 40, slight portion 35 of the top half 30 will be there between the top corners 97 and 98 and the edge of to half 30 and likewise, slight portion 45 of the bottom half 40 will be there between the bottom corner 105 and the edge of the bottom half 40. FIG. 6C, which is a side view of the side gusset pieces 95 having rhomboid shaped ends 410 being transported in longitudinal direction 50. Sectional view at Section A-A of the top and bottom halves 30 and 40 respectively of the panel plastic film 10 and the side gusset piece 95 having the rhomboid shape end 410 is shown in FIG. 6E. The top half 30 is shown bent upwards with the folded portion 36 projecting beyond the top corners 97 and 99 and the bottom half 40 is shown bent downwards with the folded portion 46 projecting beyond the bottom corner 105.

Figure 7:
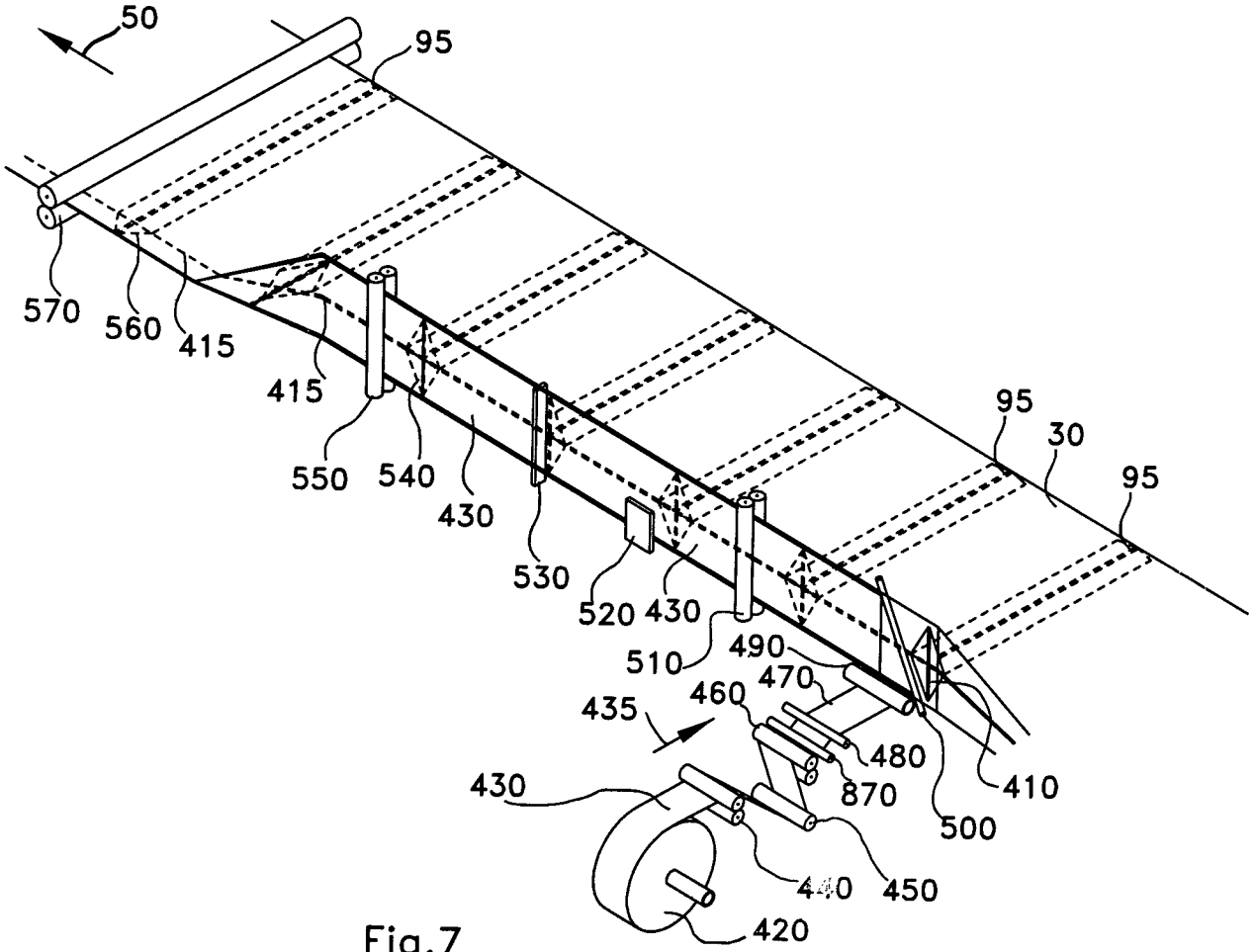
FIG. 7 shows a diagrammatic perspective representation of the transformation of the bottom gusset film into bottom gusset sealed with the panel plastic film as well as the side gussets.

FIG. 7 shows a diagrammatic perspective representation of the transformation of the bottom gusset film 430 into bottom gusset sealed with the panel plastic film 10 as well as the side gussets 95. As shown in the said figure, there is provided an unwinding reel 420 from which bottom gusset film 430 gets unwound in transverse direction 435. Bottom gusset film 430 passed through capstan nip 440 goes around accumulator roller 450 and passes through another capstan nip 460. The bottom gusset film 430 is further transported through guide rollers 470 and 480 in the transverse direction 435. The bottom gusset film 430 is transported around turn bar 500 which changes the direction as well as orientation of the bottom gusset film 430. Due to the positioning of turn bar 500, the transversely transported bottom gusset film 430 gets reoriented to be transported in longitudinal direction 50 such that the edges of the bottom gusset film 430 remain horizontal, but in a plane perpendicular to the plane when the said bottom gusset film 430 was being transported transversely in transverse direction 435. In other words, the reoriented bottom gusset film 430 is substantially perpendicular to the greater portions of the top half 30 and bottom half 40. In this position, the bottom gusset film 430 is substantially in contact with the full faces rhomboid shaped ends 410 of the side gusset pieces 95 and also respectively the folded portion 36 of the top half 30 and folded portion 46 of the bottom half 40 including the slight portions 35 and 45 of the top half 30 and bottom half 40.

As the top half 30 and bottom half 40 together with side gusset pieces 95 are further transported in longitudinal direction 50, the folded portions 36 and 46 of the top half 30 and bottom half 40, together with the rhomboid shaped ends 410 and the bottom gusset film 430 are also transported in the longitudinal direction 50; however, the folded portions 36 and 46 of the top half 30 and bottom half 40, together with the rhomboid shaped ends 410 and the bottom gusset film 430 pass through a pair of vertical guide rollers 510. A vertical heat sealer 530 vertically seals along the vertical axis 416 of the rhomboid 410 extending the seal in upward direction beyond the top corners 97 and 99 to the top edges of the bottom gusset film 430 and folded portion 36 of the top half 30 and in downward direction beyond the bottom corner 105 to the bottom edges of the bottom gusset film 430 and folded portion 46 of the bottom half 40. Thus, vertical seal 540 seals the bottom gusset film 430 with the rhomboid shaped ends 410 of the side gusset pieces 95 and also respectively the folded portions 36 and 46 of the top half 30 and bottom half 40.

After the vertical seal 540, the top half 30 and bottom half 40 together with side gusset pieces 95 are further transported in longitudinal direction 50, the folded portions 36 and 46 of the top half 30 and bottom half 40, together with the rhomboid shaped ends 410 and the bottom gusset film 430 are also transported in the longitudinal direction 50; however, the folded portions 36 and 46 of the top half 30 and bottom half 40, together with the rhomboid shaped ends 410 and the bottom gusset film 430 pass through another pair of vertical guide rollers 540.

Figure 8A:
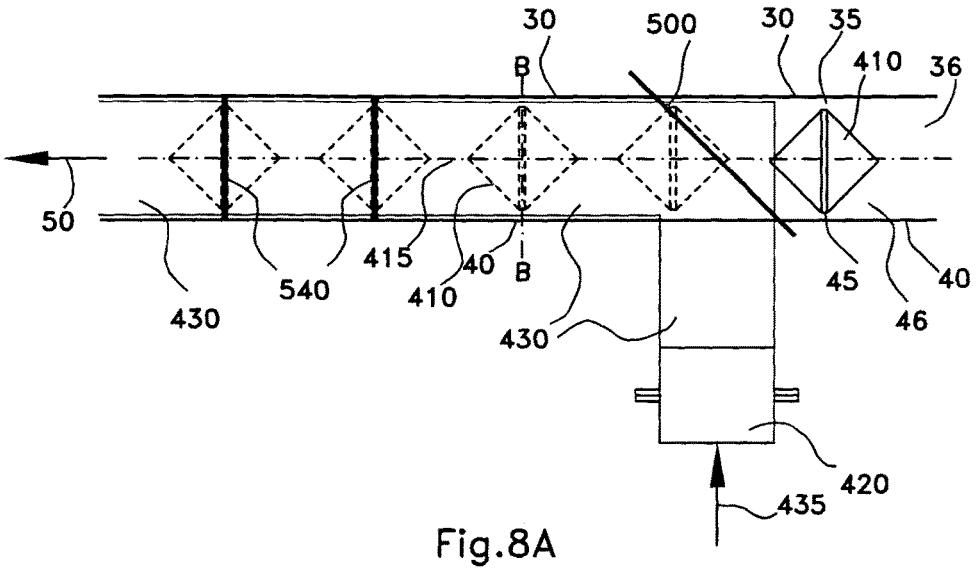
FIG. 8A substantially shows side view of the attachment of the bottom gusset film with the rhomboid shaped ends of the side gussets and the panel plastic film.
Figure 8B:
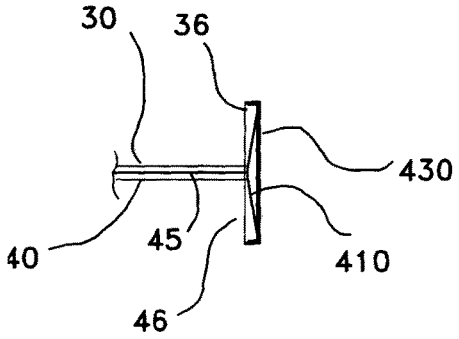
FIG. 8B is a transverse cross-section of the side gusset piece placed inside the top and bottom halves of the panel plastic film showing the folded portions of the top and bottom halves of the panel plastic film, the rhomboid shaped end of the side gusset piece, and the bottom gusset film.

FIG. 8A shows the reoriented bottom gusset film 430 in contact with the rhomboid shaped ends 410 and parallel to the folded portions 36 and 46 of the top half 30 and bottom half 40 respectively at section B-B and before section B-B: As can be seen, vertical seal 540 seals the bottom gusset film 430 with the rhomboid shaped ends 410 along the vertical line of the rhomboid and also with the slight portions 35 and 45 of the top half 30 and bottom half 40 respectively. FIG. 8 B shows the transverse cross-section at section B-B showing the folded portions 36 and 46 of the top and bottom halves 30 and 40 respectively of the panel plastic film, the rhomboid shaped end of the side gusset piece, and the bottom gusset film.

Figure 9:
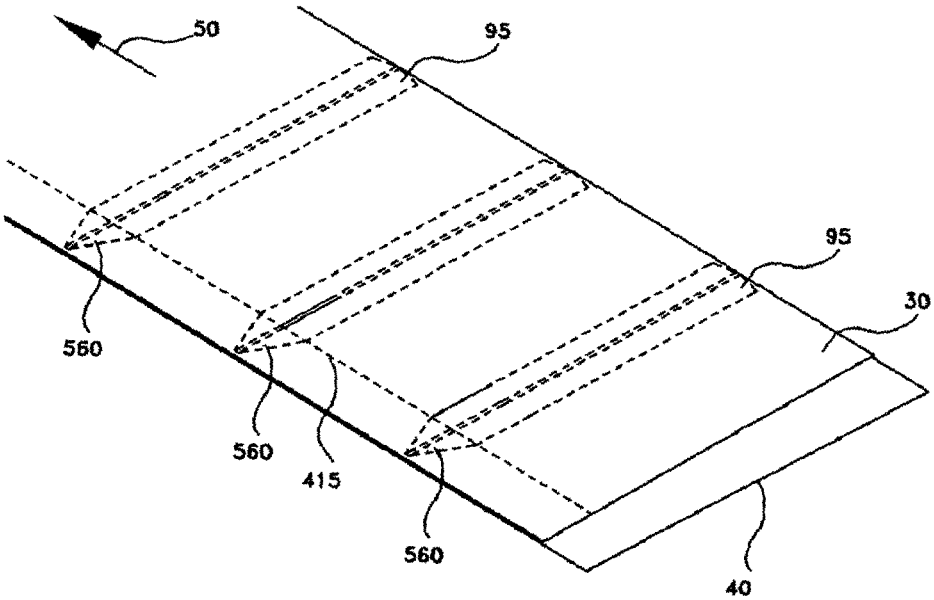
FIG. 9 shows a perspective view of the collapsed ends of the side gussets inside the panel plastic film.

The vertically sealed bottom gusset film 430 as described hereinabove is then collapsed along longitudinal dotted line 415 such that the location of the top corners 97 and 99 and that of the bottom corner 105 of the rhomboid shaped end 410 would be substantially same. In other words, viewing from the top, after the said step of collapsing, the ends of the sick gusset pieces 95 would be of triangular shape 560. As can be understood, there will be a top triangular shape 560 and a similar bottom triangular shape 560 substantially overlying each other. The base of the triangular shape 560 would fall along, the longitudinal dotted line 415. FIG. 9 illustrates the above in greater detail.

The top and bottom halves 30 and 40 of the panel plastic film 10 with the side gussets 95 and the bottom gusset film 430 sealed as aforementioned, get transported further in longitudinal direction 50 through a pair of rollers 570.

Figure 10:
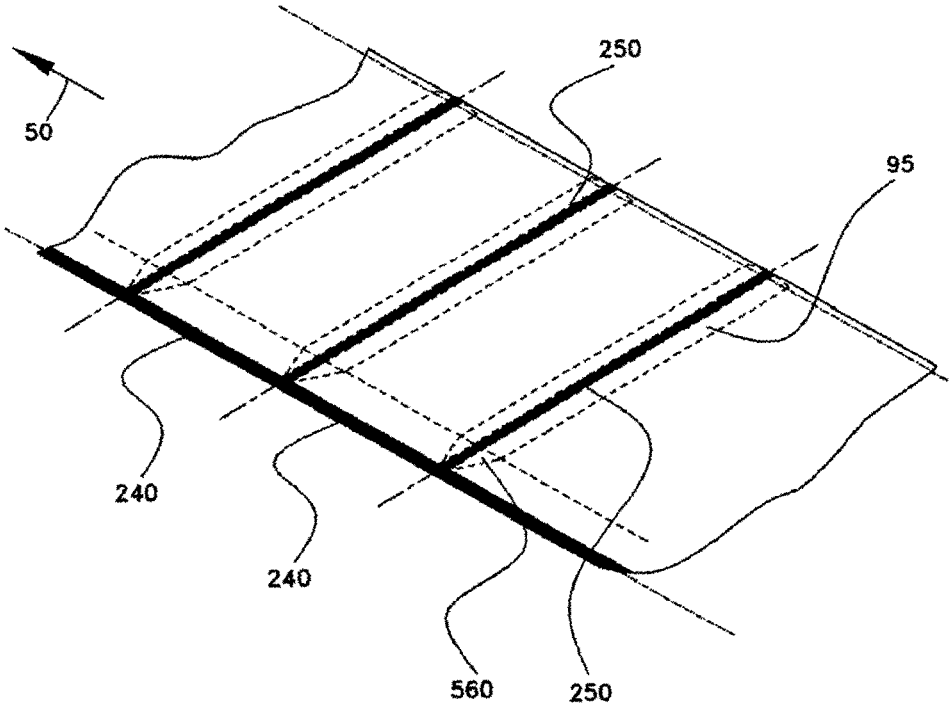
FIG. 10 shows a perspective view of the longitudinal and transverse sealing of the bottom gusset and side gussets respectively.

A longitudinal heat sealer 140 seals the top edge of the bottom gusset film 430 together with the edge of the top half 30 and the bottom edge of the bottom gusset film 430 with the edge of the bottom half 40 as shown in FIG. 10. Thus, there is a longitudinal seal 240 on the top as well as on the bottom. A transverse heat sealer 160 seals across the width of the top and bottom halves 30 and 40 of the panel plastic film 10. The transverse seal 240 seals the top edge of the side gusset piece 95 with the top half 30 and the bottom edge of the side gusset piece 95 with the bottom half 40. This transverse seal 250 takes place where transverse sealing 405 had already taken place; however, transverse seal 250 is a stronger seal than the transverse seal 405. Thus, the transverse seal 250 essentially divides side gusset pieces 95 along the length of the side gusset pieces 95. In other words, the plastic pouches 260 are essentially ready to be cut after the said longitudinal seal 240 and transverse seal 250 take place.

Figure 11A:
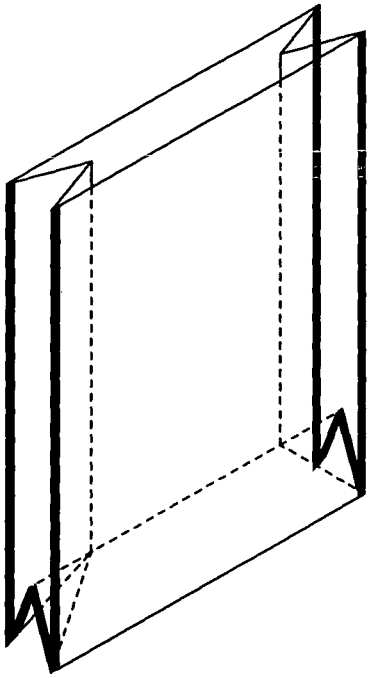
FIG. 11A shows perspective view of a plastic pouch made in accordance with the present invention in a partially expanded state.
Figure 11B:
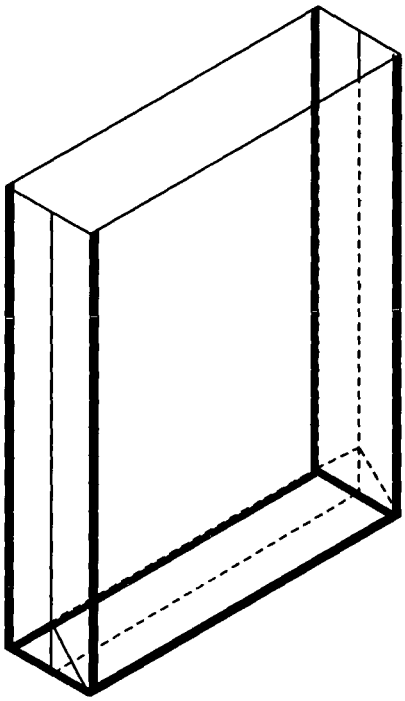
FIG. 11B shows perspective view of a plastic pouch made in accordance with the present invention in fully expanded state.

Next step is to cut using cutter 200 along the transverse seal 250. Such cutting may be required more than one time. After such cut, plastic pouch 260 is produced. FIG. 11A shows the plastic pouch 260 in partially expanded state and FIG. 11B shows the plastic pouch 260 in fully expanded state.

BEST MODE OF PERFORMING THE PRESENT INVENTION

The machine in accordance with the present invention has been described in detail hereinabove; however, the best mode of performing the present invention is to have the feeding line for the panel plastic film on one side of the machine and to have the feeding lines for the side gusset and bottom gusset on the other side of the machine. The machine in accordance with the present invention will use only one accumulator in the longitudinal direction to reduce the number of parts and also to make the foot-print of the machine as small as possible.

In the best mode of performing the present invention, heat sealers are used which permit the sealing of the side gusset pieces 95 with the panel plastic film 10 and the sealing of the bottom gusset film 430 with the panel plastic film 10 as well as the side gusset pieces 95, the reason being the choice of the material for the side gusset film. Due to the material chosen for the side gusset film 280, due to heat, the side gusset film 280 will not have a tendency to stick to some portions of itself. Likewise, the material chosen for the bottom gusset film 430 is also such that it will not have a tendency to stick with portions of itself under heat.

As aforementioned, the machine and the method in accordance with the present invention use a panel plastic film 10 from a single unwinding reel 15 as opposed to the different sources for providing top half 30 and bottom half 40 of the panel plastic film 10.

The panel plastic film 10 unwinding from the said unwinding reel 15 is longitudinally folded into top and bottom halves 10 and 40 respectively and is transported using a nip 23 in longitudinal or machine direction 50. A slitter 90 slits the panel plastic film 10 along the longitudinal fold to cut the film into top and bottom halves 30 and 40 respectively. The top and bottom halves 30 and 40 respectively simultaneously get transported ensuring that any design common to the top and bottom halves 30 and 40 respectively will always accurately match. The machine in accordance with the present invention, because of this unique feature of providing the top and bottom halves 30 and 40 respectively from folding the panel plastic film 10 unwound from a single unwinding reel 15, requires only a single accumulator roller 70.

The slitting of the top and bottom halves 30 and 40 respectively by the slitter 90 creates an initial gap between the top and bottom halves 30 and 40 respectively of the panel plastic film 10. The said gap is enlarged by a top timing belt 600 and a bottom timing belt 610 that are part of transfer assembly 400 positioned transversely such that the bottom portion of the top timing belt 600 is substantially in contact with the top portion of the bottom timing belt 610. The said timing belts 600 and 610 have teeth 660 on the inside. The teeth 660 of the top timing belt 600 mesh with the teeth on the sprockets 620 and 640 on either side. Similarly, the teeth 660 of the bottom timing belt 610 mesh with the teeth on the sprockets 630 and 650 on either side. The top half 30 of the panel plastic film 10 passes through the top timing belt 600 such that the bottom surface of the top half 30 of the panel plastic film 10 is in contact with the top of the teeth 660 on the lower portion of the top timing belt 600. Similarly, the bottom half 40 of the panel plastic film 10 passes through the bottom timing belt 610 such that the top surface of the bottom half 40 of the panel plastic film 10 is in contact with the top of the teeth 660 on the top portion of the bottom timing belt 610. Thus, the gap between the top and bottom halves 30 and 40 respectively of the panel plastic film 10 will be substantially equal to the total of the thicknesses of the top and bottom timing belts 600 and 610 including the heights of the teeth 660 on both the timing belts 600 and 610. The enlargement of the gap at this stage is required to allow insertion of the side gusset pieces 95 between the top and bottom halves 30 and 40 respectively of the panel plastic film 10.

Side gusset film 280 is unwound from an unwinding reel 270 and is guided by a nip 285 to be directed to an accumulator roller 300. The side gusset film 280 exits a nip 310 and gets folded by a folding device 320 such that the folded portions are on the top and the total width of the top folded portions 335 and 336 is substantially same as the width of the bottom portion of the side gusset film 280. The side gusset film 280 is further transported in transverse direction 290 and a creasing device 340 ensures that the front and rear folded edges 331 and 332 respectively maintain their crease. The side gusset film 280 exiting the creasing device 340 is directed by a pair of guide rollers 345 to another accumulator roller 350. The side gusset film 280 is further transported in transverse direction 290 going around a tail feed 360. There is provided a print mark sensor 370 which senses print or design registration of the side gusset film 280. The side gusset film 280 gets further transported in the transverse direction 290 through an index nip 380 and gets cut into side gusset pieces 95 by a cutter 390. The rate of indexing depends on the positioning of the side gusset pieces 95 between the top and bottom halves 30 and 40 respectively of the panel plastic film 10. In other words, the width of the plastic pouch 260 will determine how far apart the side gusset pieces 95 are positioned between the top and bottom halves 30 and 40 respectively of the panel plastic film 10 which in turn determines the rate of indexation. Therefore, the wider the plastic pouch 260, the slower will be the rate of indexation and vice versa. The length of the side gusset pieces 95 will not be more than the width of the top and bottom halves 30 and 40 respectively of the panel plastic film 10 and generally, the length will be shorter than the width of the top and bottom halves 30 and 40 respectively of the panel plastic film 10. The side gusset pieces get inserted between the top and bottom halves 30 and 40 respectively of the panel plastic film 10 through the said enlarged gap.

A transverse heat sealer 100 seals the side gusset pieces 95 with the top and bottom halves 30 and 40 respectively of the panel plastic film 10. The seal is along the length of the side gusset pieces 95 sealing the free edges of the top folded portions 335 and 336 respectively with the top half 30 of the panel plastic film 10 and the corresponding middle of the bottom portion of the side gusset piece 95 with the bottom half 40 of the panel plastic film 10.

The next stage is to give the ends of the side gusset pieces 95 the shape of a rhomboid. The top half and the bottom half 30 and 40 respectively of the panel plastic film 10 are pulled away from each other. This action opens the side gusset pieces 95 in such a way that the cross-section of the space inside the side gusset pieces resembles a rhomboid like shape having a rounded corner 96 on the front folded edge 331 as well as a rounded corner 98 on the rear folded edge 332 of the side gusset piece ends. Using a roller (not shown), the said front rounded corner 96 is pushed inwards near the vertical axis 416 of the rhomboid shaped space and similarly, using another roller (not shown), the rounded rear corner 98 is also pushed inwards to be near the said vertical axis 416. This action transforms the end of the side gusset pieces 95 into rhomboid shaped ends 410 that will now have a new front corner **96*a* on the front folded edge 331 and a new rear corner 98*a* at the rear folded edge 332. Also, it will have top corners 97 and 99 at the seal 405 and a bottom corner 105 at the seal 405**.

The pulling action of the top and bottom halves 30 and 40 respectively of the panel plastic film 10 will result into a folded portion 36 of the top half 30 and similarly, a folded portion 46 of the bottom half 40 of the panel plastic film 10. The folded portions 36 and 46 are relatively small in size compared to the remaining greater portions of the top and bottom halves 30 and 40 respectively and are generally perpendicular to the remaining greater portions of the top and bottom halves 30 and 40 respectively of the panel plastic film 10.

The edge of the folded portion 36 of the top half 30 will project beyond the top corners 97 and 99 of the rhomboid shaped ends 410 and likewise, the edge of the folded portion 46 of the bottom half 40 will project beyond the bottom corner 105 of the rhomboid shaped ends 410. In other words, the combined height of the folded portions 36 and 46 respectively of the top half 30 and the bottom half 40 of the panel plastic film 10 will be greater than the height of the rhomboid shaped ends 410.

Bottom gusset film 430 unwinding from and unwinding reel 420 is transported in transverse direction 435 and is directed to go around an accumulator roller 450 using a nip 440 positioned before and a nip 460 after the said accumulator roller 450. The bottom gusset film 430 is further transported in the transverse direction 435 using two separate guide rollers 470 and 480. There is provided a turn bar 500 which changes the direction as well as the orientation of the bottom gusset film 430 which gets reoriented to be now transported in longitudinal direction 50 such that the edges of the bottom gusset film 430 remain horizontal, but in a plane perpendicular to the plane when it was being transported transversely. In this position, the bottom gusset film 430 would be substantially parallel to the rhomboid shaped ends as well as the folded top and bottom portions 36 and 46 respectively of the panel plastic film 10. The bottom gusset film 430 at this stage is substantially in contact with the full faces of the rhomboid shaped ends 410 as also the folded top and bottom portions 36 and 46 respectively of the top and bottom halves 30 and 40 respectively of the panel plastic film 10.

The next stage is to vertically heat-seal the bottom gusset film 430 with the rhomboid shaped ends 410 along the vertical axis 416 of the rhomboid shaped ends 410 of the side gusset pieces 95. The bottom gusset film 430 also gets sealed with the top and bottom folded portions 36 and 46 respectively of the top and bottom halves 30 and 40 respectively of the panel plastic film 10 where the top and bottom folded portions 36 and 46 respectively project above and below the top corners 97 and 99 and the bottom corner 105 of the rhomboid shaped ends 410.

The top and bottom halves 30 and 40 respectively of panel plastic film 10 together with side gusset pieces 95 and the vertically sealed bottom gusset film 430 with the rhomboid shaped ends 410 as well as the folded portions 36 and 46 of the top and bottom halves 30 and 40 respectively of panel plastic film 10 get further transported in longitudinal direction 50. The bottom gusset film 430 with the rhomboid shaped ends 410 as well as the folded portions 36 and 46 respectively of the top and bottom halves 30 and 40 respectively of panel plastic film 10 pass through an index nip 550.

The next step is to collapse the bottom gusset film 430 with the rhomboid shaped ends 410 as well as the folded portions 36 and 46 respectively of the top and bottom halves 30 and 40 respectively of panel plastic film 10 such that the rhomboid shaped ends 410 have the top corners 97 and 99 substantially contacting the bottom corner 105 resulting in a triangular top part and a triangular bottom part. At this stage, the top and bottom edges of the bottom gusset film 430 also would be substantially in contact with each other as well as the edge of the top portion 36 and the edge of the bottom portion 46 also would be substantially in contact with each other. It can be seen that at this stage, the folded portions 36 and 46 respectively of the top and bottom halves 30 and 40 respectively of the panel plastic film 10 get unfolded.

The so collapsed top and bottom halves 36 and 46 respectively of the panel plastic film 10 together with side gusset pieces 95 and the bottom gusset film 430 with the rhomboid shaped ends 410 as well as the folded portions 36 and 46 respectively of the top and bottom halves 30 and 40 respectively of panel plastic film 10 get further transported in longitudinal direction 50 and are ready for final longitudinal and transverse sealing before getting cut into pouches 260.

A longitudinal heat sealer 140 seals the top edge of the bottom gusset film 430 with the edge of the top half 30 of the panel plastic film 10 and simultaneously, in a reciprocating action, the bottom edge of the bottom gusset film 430 gets longitudinally sealed with the edge of the bottom half 40 of the panel plastic film 10.

A transverse heat sealer 160 seals the top edge of the side gusset pieces 95 with the edge of the top half 30 of the panel plastic film 10 in a reciprocating action, the bottom edge of the side gusset pieces 95 get sealed with the bottom half 40 of panel plastic film 10.

The transverse sealing also seals the front collapsed edge of the bottom gusset film 430 with the corresponding collapsed edge of the side gusset piece 95 in the front. Similarly, the rear collapsed edge of the bottom gusset film 430 gets sealed with the corresponding collapsed edge of the side gusset piece 95 in the rear.

The next step is to cut along the transverse seal 250 and more than one cut may be required to produce plastic pouches 260 having two side gussets and one bottom gusset.

The principle of operation of the machine in accordance with the present invention as also the invented method of producing plastic pouches with two side gussets and one bottom gusset has been described in detail hereinabove can be applied with some variations in the machine which contains numerous components and the method which involves several steps.

As a person skilled in the art will readily understand from the detailed description of the present invention, merely because some changes may be made to the machine or to the method disclosed hereinabove without departing from the spirit and scope of the present invention, so modified machine or method should not be construed to fall outside the scope of the present invention as disclosed and claimed herein. All matters disclosed hereinabove or as shown in the accompanying drawings ought to be interpreted as illustrative and not in a limiting sense.

The following claims are intended to cover all of the generic and specific features of the present invention described hereinabove and all the statements of scope of the present invention regardless of the grammatical or linguistic variations might be said to fall therebetween.

We claim:

1. A machine for making plastic pouches having three gussets comprising:

a. a panel plastic film unwinding means adapted to provide a panel plastic film;

b. a folding device adapted to longitudinally fold in half the panel plastic film;

c. a pair of guide rollers adapted to receive the folded panel plastic film and to transport the folded panel plastic film longitudinally;

d. an accumulator roller adapted to receive the folded panel plastic film and to further transport it in longitudinal direction;

e. a slitter adapted to slit into top and bottom halves the folded panel plastic film along the longitudinal fold and to create an initial gap substantially the same as a thickness of the slitter between the top and bottom halves of the panel plastic film;

f. a means to enlarge the gap between the top and bottom halves of the panel plastic film;

g. a side gusset plastic film unwinding means adapted to provide a side gusset plastic film;

h. an accumulator roller adapted to receive the side gusset plastic film unwound from the side gusset plastic film unwinding means and to transport the side gusset plastic film in a transverse direction;

i. a means to longitudinally fold the side gusset plastic film such that the folded portions are on the top and the combined width of the folded top portions is substantially same as the width of the bottom portion;

j. a creasing device adapted to maintain the crease at the folds in the unwound folded side gusset plastic film;

k. an accumulator roller adapted to receive the folded side gusset plastic film and to transport it further in transverse direction;

l. a means to cut the folded side gusset plastic film into side gusset pieces having a length less than or equal to the width of the top and bottom halves of the folded panel plastic film;

m. a pair of index rollers adapted to intermittently transport in the transverse direction the side gusset pieces such that the side gusset pieces are placed through the enlarged gap between the top and bottom halves of the panel plastic film at a predetermined distance from each other;

n. a transverse sealing means to seal the side gusset pieces along the length of the side gusset pieces with the top and bottom halves of the panel plastic film such that at least the edges of the folded top portions of the side gusset piece are sealed with the bottom surface of the top half of the panel plastic film and at least the corresponding middle of the bottom portion of the side gusset piece is sealed with the top surface of the bottom half of the panel plastic film;

o. a means to pull the top and bottom halves of the panel plastic film away from each other at the location of the side gusset creating a folded top portion of the top half of the panel plastic film that is substantially perpendicular to the greater parts of the top half of the panel plastic film and a folded bottom portion of the bottom half of the panel plastic film that is substantially perpendicular to the greater parts of the bottom half of the panel plastic film and to transform the shape of the end of the side gusset piece into a rhomboid-like shape having rounded front and rear corners;

p. a means to push inwards the front and rear corners of the rhomboid-like shaped end of the side gusset piece and to form two vertical edges that are substantially parallel to the vertical axis of the rhomboid-like end and to transform the rhomboid-like end into a rhomboid creating new front and rear corners of the rhomboid, the rhomboid shaped end being substantially perpendicular to the greater parts of the top and bottom halves of the panel plastic film;

q. a bottom gusset plastic film unwinding means adapted to provide a bottom gusset plastic film;

r. an accumulator roller adapted to receive the unwound bottom gusset plastic film and to transport the unwound bottom gusset plastic film in the transverse direction;

s. a pair of index rollers adapted to transport in the transverse direction the bottom gusset plastic film;

t. a turn bar adapted to reorient the bottom gusset film to be transported in the longitudinal direction and to be substantially in contact with the full face of the rhomboid shaped ends of the side gusset pieces and the folded top and bottom portions of the top and bottom halves of the panel plastic film;

u. a sealing means to seal along the vertical edges within the rhomboid shaped ends of the side gusset pieces, the sealing extending beyond the vertical edges up to the edges of the folded top and bottom portions of the top and bottom halves of the panel plastic film;

v. a means to collapse into equal top and bottom halves the bottom gusset film sealed with the rhomboid shaped end of the side gusset and the top and half folded portions of the top and bottom panel plastic film;

w. a sealing means to longitudinally seal the top edge of the bottom gusset film with the edge of the top half of the panel plastic film and the bottom edge of the bottom gusset film with the edge of the bottom half of the panel plastic film;

x. at least one sealing means to transversely further seal the top edge of the side gusset piece with the top half of the panel plastic film and the bottom edge of the side gusset piece with the bottom half of the panel plastic film, the seal also sealing the edges of the side gusset piece with the corresponding contacting edges of the bottom gusset film;

y. a means to transversely cut along substantially the middle of the length of the side gusset pieces and top and bottom halves of the panel plastic film.

2. The machine of claim 1 wherein the means to enlarge the gap between the top and bottom halves of the panel plastic film comprises a transversely moving top timing belt with the teeth of the top timing belt in contact with the bottom surface of the top half of the panel plastic film and a transversely moving bottom timing belt with the teeth of the bottom timing belt in contact with the top surface of the bottom half of the panel plastic film.

3. The machine of claim 2 wherein the outer toothless surfaces of the top and bottom timing belts are in contact with each other such that the gap between the top and bottom halves of the panel plastic film is substantially same as the total of the thicknesses of both the belts where they contact each other and the heights of the teeth on the contacting parts of the timing belts.

4. The machine of claim 1 wherein the sealing means to partly seal the side gusset pieces along the length of the side gusset pieces with the top and bottom halves of the panel plastic film comprises a heat sealer.

5. The machine of claim 1 wherein the sealing means to vertically seal along the vertical edges within the rhomboid shaped ends of the side gusset pieces comprises a heat sealer.

6. The machine of claim 1 wherein the sealing means to longitudinally seal the top edge of the bottom gusset with the top half of the panel plastic film and the bottom edge of the bottom gusset with the bottom half of the panel plastic film comprises a heat sealer.

7. The machine of claim 1 wherein the sealing means to transversely further seal the side gusset pieces with the top and bottom halves of the panel plastic film comprises a heat sealer.

8. A method of manufacturing plastic pouches having three gussets comprising the steps of:

a. unwinding a panel plastic film and transporting the panel plastic film to a folding device;

b. longitudinally folding the unwound panel plastic film in half;

c. longitudinally transporting the folded panel plastic film through a pair of guide rollers;

d. accumulating the folded panel plastic film around an accumulator roller and further transporting the folded panel plastic film in the longitudinal direction;

e. slitting into top and bottom halves the folded panel plastic film along the longitudinal fold and creating an initial gap substantially same as a thickness of the slitter between the top and bottom halves of the panel plastic film;

f. enlarging the gap between the top and bottom halves of the panel plastic film;

g. unwinding a side gusset plastic film;

h. accumulating the unwound side gusset plastic film around an accumulator roller, and further transporting the unwound side gusset plastic film it in a transverse direction;

i. longitudinally folding the side gusset plastic film such that the folded portions are on the top and the combined width of the top portions is substantially the same as the width of the bottom portion;

j. creasing the folds in the unwound folded side gusset film to maintain the crease at the folds;

k: accumulating the folded side gusset plastic film around an accumulator roller and further transporting the folded side gusset plastic film in the transverse direction;

l. cutting the folded side gusset plastic film into side gusset pieces having a length less than or equal to the width of the top and bottom halves of the folded panel plastic film;

m. intermittently transporting in the transverse direction using a pair of index rollers the side gusset pieces such that the side gusset pieces are placed through the enlarged gap between the top and bottom halves of the panel plastic film at a predetermined distance from each other;

n. transversely sealing the side gusset pieces along the length of the side gusset pieces with the top and bottom halves of the panel plastic film such that at least the edges of the folded top portions of the side gusset pieces are sealed with the bottom surface of the top half of the panel plastic film and at least the middle of the bottom portion is sealed with the top surface of the bottom half of the panel plastic film;

o. pulling the top and bottom halves of the panel plastic film away from each other at the location of the side gusset creating a folded top portion of the top half of the panel plastic film that is substantially perpendicular to the greater parts of the top half of the panel plastic film and a folded bottom portion of the bottom half of the panel plastic film that is substantially perpendicular to the greater parts of the bottom half of the panel plastic film and transforming the shape of the end of the side gusset piece into a rhomboid-like shape having rounded front and rear corners;

p. pushing inwards the front and rear corners of the rhomboid-like shaped end of the side gusset piece and forming two vertical edges that are substantially parallel to the vertical axis of the rhomboid-like end and transforming the rhomboid-like end into a rhomboid creating new front and rear corners of the rhomboid, the rhomboid shaped end being substantially perpendicular to the greater parts of the top and bottom halves of the panel plastic film;

q. unwinding a bottom gusset plastic film;

r. accumulating the unwound bottom gusset plastic film using an accumulator roller and transporting the unwound bottom gusset plastic film in the transverse direction;

s. transporting in the transverse direction the bottom gusset plastic film using a pair of index rollers;

t. reorienting the bottom gusset film using a turn bar and transporting the bottom gusset film in the longitudinal direction and to be substantially in contact with the full face of the rhomboid shaped ends of the side gusset pieces and the folded top and bottom portions of the top and bottom halves of the panel plastic film;

u. sealing along the vertical edges within the rhomboid shaped ends of the side gusset pieces, the sealing extending beyond the vertical edges up to the edges of the folded top and bottom portions of the top and bottom halves of the panel plastic film;

v. collapsing into equal top and bottom halves the bottom gusset film sealed with the rhomboid shaped end of the side gusset and the top and half folded portions of the top and bottom panel plastic film;

w. longitudinally sealing the top edge of the bottom gusset film with the edge of the top half of the panel plastic film and the bottom edge of the bottom gusset film with the edge of the bottom half of the panel plastic film;

x. transversely further sealing the top edge of the side gusset piece with the top half of the panel plastic film and the bottom edge of the side gusset piece with the bottom half of the panel plastic film, the seal also sealing the edges of the side gusset piece with the corresponding contacting edges of the bottom gusset film;

y. transversely cutting along substantially the middle of the length of the side gusset pieces and top and bottom halves of the panel plastic film.

9. The method of claim 8 wherein the gap between the top and bottom halves of the panel plastic film is enlarged by transversely moving a top timing belt with the teeth of the said top timing belt in contact with the bottom surface of the top half of the panel plastic film and a transversely moving bottom timing belt with the teeth of the said bottom timing belt in contact with the top surface of the bottom half of the panel plastic film.

10. The method of claim 9 wherein the outer toothless surfaces of the top and bottom timing belts are contacting each other such that the gap between the top and bottom halves of the panel plastic film is substantially same as the total of the thicknesses of both the belts where they are contacting each other and the heights of the teeth on the contacting parts of the timing belts.

11. The method of claim 8 wherein a heat sealer partly seals the side gusset pieces along the length of the side gusset pieces with the top and bottom halves of the panel plastic film.

12. The method of claim 8 wherein a heat sealer vertically seals along the vertical edges within the rhomboid shaped ends of the side gusset pieces.

13. The method of claim 8 wherein a heat sealer longitudinally seals the top edge of the bottom gusset with the top half of the panel plastic film and the bottom edge of the bottom gusset with the bottom half of the panel plastic film.

14. The method of claim 8 wherein a heat sealer transversely further seals the side gusset pieces with the top and bottom halves of the panel plastic film.

* * * * *